US005804759A

United States Patent [19]

Sauvestre

[11] Patent Number: 5,804,759

[45] **Date of Patent: *Sep. 8, 1998**

[54] HUNTING BULLET HAVING A TELESCOPING FLECHETTE AND COMPRISING A SUB-PROJECTILE CONNECTED TO A LAUNCHER

[76] Inventor: Jean-Claude Sauvestre, 64 rue de la Vallée F-18230, Saint-Doulchard, France

[ * ] Notice: This patent issued on a continued prosecution application filed under 37 CFR 1.53(d), and is subject to the twenty year patent term provisions of 35 U.S.C. 154(a)(2).

[21] Appl. No.: 663,305

[22] PCT Filed: Oct. 26, 1995

[86] PCT No.: PCT/FR95/01418

§ 371 Date: Jun. 25, 1996

§ 102(e) Date: Jun. 25, 1996

[87] PCT Pub. No.: WO96/13697

PCT Pub. Date: May 9, 1996

[30] Foreign Application Priority Data

Oct. 26, 1994 [FR] France ..... 94 12835

[51] Int. Cl.[6] ..... F42B 5/00; F42B 12/02

[52] U.S. Cl. ..... 102/439; 102/517; 102/518; 102/521; 244/3.26

[58] Field of Search ..... 102/430, 439, 102/501, 517–523, 473, 490, 498, 503, 506–510, 514–516, 529, 703; 244/3.26, 3.1, 3.3

[56] References Cited

U.S. PATENT DOCUMENTS

| | | | |
|---|---|---|---|
| H198 | 1/1987 | Stone | 102/524 |
| 4,135,449 | 1/1979 | Prochnow et al. | 102/518 |
| 4,788,915 | 12/1988 | Sauvestre | 102/501 |
| 4,977,834 | 12/1990 | Denis | 102/439 |

FOREIGN PATENT DOCUMENTS

| | | | |
|---|---|---|---|
| 333542 | 9/1989 | European Pat. Off. . | |
| 2 335 818 | 7/1977 | France . | |
| 2437603 | 4/1980 | France . | |
| 2 555 728 | 5/1985 | France . | |
| 2599828 | 12/1987 | France . | |
| 2602042 | 1/1988 | France . | |
| 2547503 | 4/1977 | Germany . | |
| 1118847 | 10/1994 | Russian Federation | 102/517 |
| 252081 | 5/1926 | United Kingdom | 244/3.26 |

*Primary Examiner*—Harold J. Tudor
*Attorney, Agent, or Firm*—Foley & Lardner

[57] ABSTRACT

An ammunition cartridge comprises a full bullet 1 held in a primer socket D containing a propellant charge P. The bullet 1 includes an flechette 2 and a launcher 10 concentrically received on the flechette to allow relative translation. The flechette 1 comprises an flechette body 3 of hard material having a conical head 4, and a stabilizer 6 fixed to a rear of the body 3. The stabilizer 6 has an integral lip 8 which seals the bullet 1 in the barrel to optimize pressure build-up during firing. The launcher translates forward relative to the flechette when released from the primer socket D. The full bullet remains intact in flight. The launcher strikes the target first and transmits high energy to the target. Immediately thereafter, the flechette translates forward to penetrate the target.

14 Claims, 3 Drawing Sheets

HUNTING BULLET HAVING A TELESCOPING FLECHETTE AND COMPRISING A SUB-PROJECTILE CONNECTED TO A LAUNCHER

The present invention relates to ammunition for small, medium or large-calibre weapons and, more particularly, to a new telescoping-flechette bullet, of the type comprising a sub-projectile connected to a launcher, set in motion by a propulsion system.

Ammunition of the flechette type is known in the military and sporting fields and, for example, patent FR-A-2.335.818 describes hunting ammunition comprising a subcalibre projectile fin-stabilized, connected to a launcher sabot. The latter is produced from a material which is likely to fragment when the ammunition leaves the tube, and the dispersion of the fragments thus constitutes a danger to the safety of the user. In addition, the "thrust" launching used in this patent results in a sub-projectile which is very short, in is which the L/D ratio (length of the sub-projectile/diameter of the body of the sub-projectile) cannot exceed 2,5, accordingly resulting in a limited energy balance upon impact.

Patent FR-A-2.627.854 relates to sporting ammunition comprising a projectile formed by an internal element, the front and the side walls being covered by an external element in the form of a sleeve. The internal metal element comprises a head in a neutralizing shape which is integral with a rear flechette on which it is possible for a hammer to slide in order to increase the neutralizing effect of the projectile at the time of impact. The external element does, however, remain attached to the internal element during the entire trajectory of the projectile; it is not possible for it to be assimilated with a launcher such as that used in flechette bullets and does not provide the same advantages. The launching principle of this projectile is also of the "thrust" type, and the L/D ratio cannot exceed about 3, also resulting in a weak force on impact on the target.

In addition, drawbacks of this type of projectile are that it produces a strong aerodynamic drag and is sensitive to cross-wind. These projectiles also have a certain propensity to ricochet off obstacles such as tree trunks.

Patent FR-A-2.555.728 describes ammunition of the flechette type, i.e. comprising a sub-projectile which is finstabilized, which is connected to a detachable sabot of the "draw-thrust" type, the effect of which is to ensure the guiding and the tightness during the passage of the ammunition in the tube. The sub-projectile has a tapering shape and is produced from a material of high density, conferring on it a considerable surface energy at the time of impact. This feature does, however, present a drawback in that it frequently causes only light injuries to the game, it being possible, in fact, for the sub-projectile to pass through the soft outer skin of the game without encountering any hard part. In addition, it is possible for the projectile to be carried for a considerable distance if the target was missed, due to its good stability in maintaining its trajectory, and it may then pose a danger to persons in the vicinity.

Patent FR-A-2.602.042 describes ammunition also comprising a projectile of the flechette type, the launching of which is of the "thrust" type. The sub-projectile which is connected to a sabot is stabilized by fins which are mounted to slide on the body of the sub-projectile, thereby ensuring an increase in the length, and the L/D ratio is of the order of 3,5. The energy balance of this type of ammunition does, however, remain insufficient, and the accuracy of the shot at normal distances is not always satisfactory, as is, moreover, the case for all ammunition using the "thrust" type of launching.

All the projectiles described in the above-mentioned patents comprise a monobloc launching system or a launching system of a composite construction, produced essentially of plastics material, which has the drawback that, in respect of certain projectiles such as those of patent FR-A-2.627.854, it has a low density, resulting in a low stopping power in respect of the game. For other projectiles, the launching system of a composite construction, detachable at the mouth of the weapon, as in patent FR-A-2.335.818, involves a substantial loss in energy.

The object of the present invention is flechette-type ammunition, comprising a sub-projectile (flechette) connected to a launcher at the calibre of the weapon. The unit formed by the sub-projectile (or flechette) and the launcher (or sabot) is enclosed, at least partially, in a cartridge which, in addition, comprises a primer socket and a propellant charge. This ammunition has characteristic features which make it possible for the drawbacks of the above known projectiles to be prevented, and it may be used, in particular, in small, medium and large calibre hunting weapons, rifled or not rifled, and in military training weapons.

The ammunition, according to the invention, for small, medium and large calibre weapons is of the type comprising a sub-projectile which comprises a stabilizer, connected to a launcher at the calibre of the weapon, the unit being at least partially enclosed in a cartridge which, in addition, comprises a primer socket and a propellant charge, and is distinguished in that the launcher is non-detachable and is mounted to slide longitudinally on the sub-projectile.

According to a preferred embodiment, the ammunition according to the invention comprises a thrust plate which may be integrated into the fin. In a simplified embodiment, the thrust plate may serve as a stabilizer.

The thrust plate is integral with the body of the sub-projectile and is preferably situated slightly upstream of the rear extremity of the sub-projectile. It is intended to ensure the mechanical behaviour of the launcher during the propulsion phase of the bullet and the tightness to the propellant gases between the complete bullet and the tube of the weapon. This tightness may be improved by a seal placed on the outer surface of the thrust plate. According to one embodiment, said seal is formed by a flexible lip at the periphery of the thrust plate, to the rear thereof. The tightness may be further reinforced, for example, by an annular or toric seal provided on the outer surface of the thrust plate.

The thrust plate also makes it possible to guide the full bullet during the launching phase.

In addition, the slightly conical form of the stabilizer, or of the flexible sealing lip, simplifies encartridging operations.

In its most simple form, the stabilizer comprises only the thrust plate completed by a seal. The thrust plate may be produced from a plastic material and may, advantageously, incorporate the stabilizer, the two components, i.e. the thrust plate and the stabilizer, accordingly forming only a single part.

According to the present invention, the ammunition comprises a launcher formed by a revolving part and comprises two concentric bores, and the diameter of the front bore is preferably greater than the diameter of the rear bore.

More particularly, the launcher is formed by a sleeve which may slide longitudinally on the body of the sub-projectile, between a recoiled position and a forward position, and in said last-mentioned position the total length of the full bullet is substantially projecting. Consequently, there is, in particular, an improvement in the stability of the complete bullet (sub-projectile and launcher) in its trajectory, with a resultant improved accuracy of the shot. Thus, the length of the entire bullet, in the deployed position, may be in excess of about 50 to 60% relative to the length of the entire bullet in the withdrawn position.

According to a preferred embodiment of the invention, it is possible for the launcher to slide over a distance of between ¼ and ¾ of the length of the sub-projectile.

Moreover, according to the invention, the mass of the launcher is greater than that of the sub-projectile, the mass ratio of the launcher to the sub-projectile being between 2:1 and 8:1 and, preferably, between 2.5:1 and 6:1. Due to this particular configuration, the launcher of the ammunition according to the invention constitutes an energized launcher which provides the entire bullet, formed by the launcher and the sub-projectile (or arrow), with an improved effectiveness as will be shown hereinafter.

The effectiveness of the bullet on the target may be increased further by providing a launcher which may fragment under the shock of the impact, for example by using a material having a suitable resistance or by providing the beginnings of breaking points in the wall of the sleeve of the launcher.

The energized launcher may be produced from a material having a relatively substantial density, for example lead or a metal alloy, or even a mixed organo-metallic alloy. The sub-projectile is produced from a high-strength material, for example brass.

According to a different embodiment of the invention, it is possible to cover all or part of the launcher with a material having a suitable composition or suitable mechanical characteristics, or to produce the launcher in two parts of different materials. Accordingly, the launcher may comprise an outer casing of a material having a greater strength, for example of lead or a hard plastics alloy. This embodiment makes it possible for the tube of the weapon not to be fouled up or "leaded" during the launching phase and to control, more accurately, the final effect on the target to be reached.

The production of the launcher comprising two parts, for example a rear and inner part in the form of a ring sliding on the sub-projectile, produced from a high-strength material such as brass, and a front and outer part produced from lead or a lead alloy, is very particularly adapted to the case of a bullet shot at a very high acceleration during the launching phase, by ensuring an excellent mechanical behaviour of the front part of the launcher.

The front part of the launcher is provided with a form which is adapted to meet the desired effect. It may be shielded by a ballistic cap which makes it possible for the aerodynamic drag of the bullet in flight to be reduced and for the partial explosion of the launcher at the time of impact on the target to be controlled.

According to a another different embodiment according to the invention, the stabilizer is mounted to slide longitudinally on the rear part of the body of the sub-projectile. Before firing, and during the launching phase, the stabilizer is in the forward position, against the rear extremity of the launcher. On leaving the tube of the weapon, it is brought into a recoiled position, against a stop provided at the rear end of the sub-projectile, by sliding friction, due to the difference in aerodynamic drag.

The stabilizer and the thrust plate may be of a plastics alloy having an adequate mechanical resistance and a low density.

According to another variation of the present invention, the sliding launcher is produced in two concentric tubular parts, the inner part remaining integral with the sub-projectile from the launching phase until the impact on the target, while the outer part may separate off. For this purpose, the outer part of the launcher is advantageously produced from at least two detachable parts which are symmetric relative to the longitudinal axis of the launcher, becoming detached when leaving the mouth of the tube of the weapon.

In particular in the case of the launcher comprising two concentric tubular parts, it may be advantageous to provide annular nozzles which pass through the wall of the inner part of the launcher in its forward part which projects beyond the head of the flechette when the full bullet is in the deployed position. The effect of these nozzles is, in particular, to channel air from the interior of the main nozzle, which is provided in the axis of the launcher, towards the exterior and to facilitate the separation of the components forming the separable outer launcher.

This embodiment comprising a launcher composed of two parts is most particularly useful in the case of the use of the ammunition according to the present invention in weapons of a relatively high calibre, in order to maintain the bullet at a relatively small outside diameter, less than the calibre of the weapon.

The ammunition according to the present invention has the advantage that it may be used in weapons of all calibres, smooth choke-bore tube or otherwise, or having a rifled tube, both in the sphere of sporting weapons and in military training weapons.

In addition, the ammunition according to the present invention, when applied to hunting, has numerous advantages relative to known ammunition, and more particularly:

- since the launcher is not detachable, there will not be any ejection of a component likely to originate from the launcher or from the sealing system;
- it permits using all the energy of the projectile and it thus increases the power to stop the game;
- it ensures, at an identical firing pressure, an optimal initial velocity due to a minimal occupation of the volume assigned to the powder by the stabilization system of the projectile;
- it permits obtaining a very high stability of the projectile on its trajectory by increasing the margin of stability due to the telescopic mounting of the flechette/energized launcher;
- it ensures an excellent firing accuracy, more especially so at long range;

In addition, the ammunition according to the invention has an improved effectiveness and an excellent neutralizing power, since the launcher is capable of fragmenting in a controlled manner in the soft regions of the game, while the sub-projectile (arrow) of hard material, which generates a very high surface energy, can strike the hard parts of the skeleton of the game, without spoiling the venison, due to an excellent stability of the flechette when striking.

Finally, a low tendency of the ammunition according to the invention to ricochet is observed and this, in addition, may be ensured by considerably reducing the mass of lead relative to standard ammunition.

It is possible to use the same bullet for the same family of sporting weapons, for example guns having calibres of 12, 16 and 20, or to fire equally well, in the same weapon and, more particularly, in guns and rifles which are smooth-bore or slightly rifled, ammunition according to the present invention as well as standard ammunition of the small shot type.

The characteristic features and advantages of the invention are shown more clearly in the following description, with reference to the attached drawings which relate to preferred and non-limiting embodiments. In these drawings.

The exemplified embodiments of ammunition according to the invention shown in these Figures relate to sporting ammunition or small calibre ammunition, but it is obvious that these embodiments may be adapted to training ammunition without going beyond the scope of the present invention.

Figure 1:
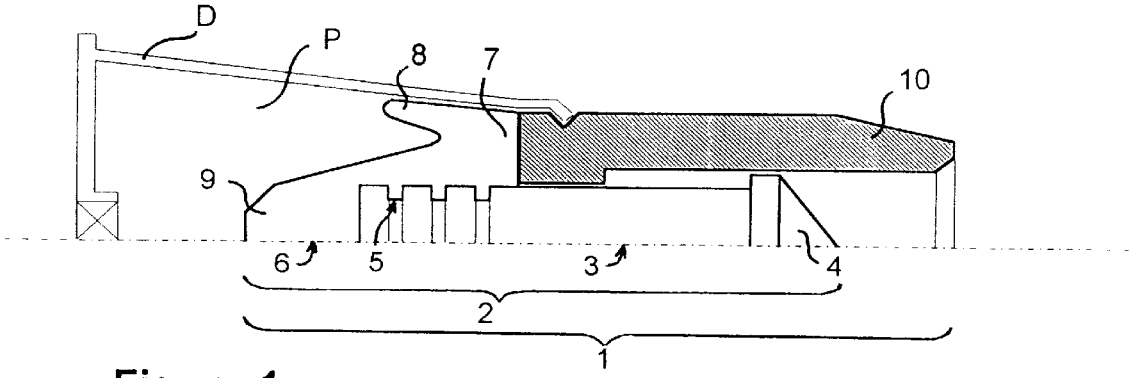
FIG. 1 is a diagrammatic section of a complete cartridge comprising a full bullet according to the invention, formed by an flechette and an energized launcher, together with a primer socket and a propellant charge.

As shown in FIG. 1, the cartridge (C) comprises the full bullet (1) and the primer socket (D) containing the propellant charge (P) which, in the present case, is a powder of the standard type.

The full bullet (1) comprises two components: the flechette (2) and the energized launcher (10) which is capable of sliding on the body of the flechette (2). When the bullet is in a position in which it is partially inserted in the cartridge, prior to use, the launcher (10) is in a retracted position, as shown in FIG. 1.

Figure 2:
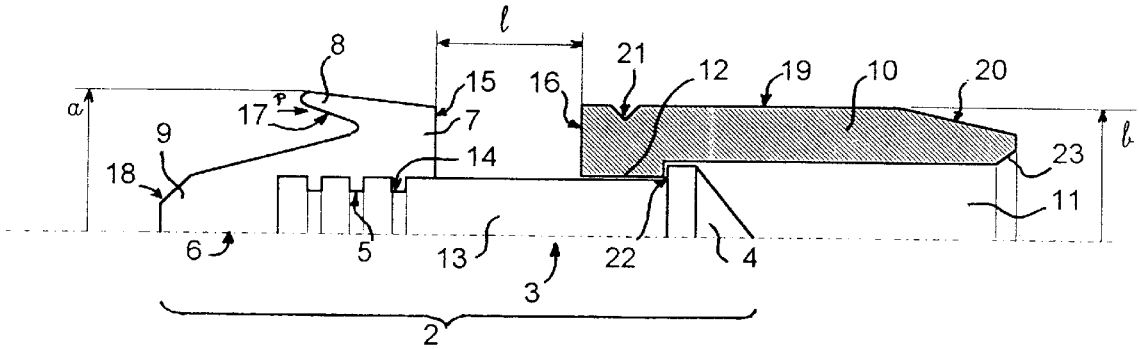
FIG. 2 is a longitudinal section of the full bullet of FIG. 1 in the deployed position.

After firing and as soon as it leaves the tube of the weapon, the bullet is in flight, in the deployed position shown in FIG. 2.

As shown in FIG. 2, the flechette (2) comprises:

a) the flechette body (3) of a hard material, comprising a conical head (4) at the front and circular grooves (5) at the rear;

b) the stabilizer (6), preferably produced from a plastics material, itself comprising the thrust plate (7) integrating the seal formed by the lip (8), and the stabilizer body (9).

The energized launcher (10) is a revolving part of a lead alloy comprising two concentric bores of different diameters, the diameter of the front bore (11) being larger than that of the rear bore (12).

The shape of the conical head (4) of the body (3) of the flechette (2) is designed to permit a good striking contact of the flechette (2) on the target and to penetrate into the matter with a very considerable neutralizing power. The outside diameter of the conical head (4) is greater than that of the middle part (13) of the flechette body (3).

This middle part (13) has a cylindrical shape. The rear part of the flechette body (3) comprises circular grooves (5) which co-operate with a complemental configuration (14) provided in the stabilizer body (9).

The thrust plate (7), incorporating the lip seal (8) of a deformable material and the stabilizer body (9), ensures the mechanical behaviour of the energized launcher (10) at the level of the surface (15) of the thrust plate (7) and of the surface (16) of the energized launcher (10) during the propulsion phase of the full bullet (1), the tightness to propellant gas between the full bullet (1) and the tube of the weapon, due to the deformable-lip seal (8), and the guiding of the full bullet (1) during the launching phase.

At half cock, the outside diameter (a) of the seal (8) is greater than the diameter of the tube of the weapon by a few tenths of a millimetre. The tightness is further reinforced during the launching phase by the pressure (p) exerted by the propellant gas on the inner surface (17) of the seal (8).

The stabilizer body (9) has, in its rear region, a conical shape (18) which facilitates the penetration of the full bullet (1) into the propellant powder (P) curing encartridging. Complemental configurations (14), which are provided in the stabilizer body (9), co-operate with the grooves (5) provided in the flechette body (3) in order to ensure the interlocking of the unit formed by the flechette body (3) and the stabilizer (6).

In the trajectory, the stabilizer (6) plays an important part by ensuring the stability of the full bullet (1) up to the target. The aerodynamic components which act on this stabilizer are considerable during the flight of the full bullet (1). The mechanical behaviour of the stabilizer (6) during this flight phase is ensured by the combination of the grooves (5) on the flechette body (3) and the complemental configuration (14) on the stabilizer body (9).

The outer part of the energized launcher (10) comprises a cylindrical part (19), the diameter (b) of which is very slightly less than that of the weapon, and an ogive part (20), the shape of which is linked to the flight characteristics and to the effects desired in respect of the penetration of the full bullet (1) into the target. The cylindrical part (19) comprises, in its rear region, a groove (21) which permits the crimping of the flange of the case after encartridging.

The inner part of the energized launcher (10) comprises two cylindrical and concentric bores. The diameter of the rear bore (12) is smaller than the diameter of the front bore (11). The connection between these two bores comprises a shoulder (22) which makes it possible to ensure the front locking in translation of the energized launcher (10) with the conical head (4) of the flechette body (3). The front bore (11), having a diameter greater than that of the rear bore (12), comprises, on its front part, an inner bevel (23), the dimensions of which are linked to the characteristics of the final effect desired for the full bullet (1). Annular clearances of a few tenths of a millimetre are provided between the rear bore (12) of the energized launcher (10) and the middle part (13) of the flechette body (3), and between the front bore (11) and the head (4) of the flechette body (3). These annular clearances permit a free sliding of the energized launcher (10) over the distance (1).

In a half-cocked position, prior to firing, the distance 1 is equal to 0, the rear surface (16) of the energized launcher (10) being in contact with the surface (15) of the thrust plate (7).

The working of the bullet illustrated in FIG. 2 is as follows.

At the start of the shot, and during pressure build-up, the uncrimping of the case is carried out with the aid of the groove (21) of the energized launcher (10). During the propulsion phase of the full bullet, the energized launcher (10), while ensuring guiding of the bullet in the tube of the weapon, is in contact with the thrust plate (7) of the stabilizer (6) via the surface (15) of the thrust plate (7) and via the surface (16) of the launcher (10). The complete tightness to propellant gas is ensured by the lip seal (8) which is integrated in the thrust plate (7). The full bullet (1) is thus in its retracted position.

Upon leaving the tube of the weapon, the energized launcher (10), free in translation, slides towards the front on the flechette body (13) of the flechette (2) , to come to abut against the conical head (4) of the flechette (2). This displacement is shown by the length 1 on FIG. 2. This sliding movement is achieved due to the difference in aerodynamic drag on the flechette (2) and on the energized launcher (10), the aerodynamic drag of the launcher (10) being less than that of the flechette (2).

Accordingly, the entire bullet (1) is then in the deployed position and the flechette (2) is guided by the energized launcher (10) over the entire trajectory, up to the target. The deployed position of the bullet in the trajectory makes it possible to obtain an exceptional stability of the bullet by increasing the margin of stability defined by the distance separating the centre of the aerodynamic forces and the centre of gravity of the deployed full bullet.

The attack mechanism on the target is carried out in two phases, as described below.

In a first phase, the energized launcher (10) strikes, firstly, the target via the front face with the total energy of the complete bullet (1).

At this precise moment, three phenomena become evident in chronological order:

a-a first neutralizing effect becomes evident, as a result of the increased kinetic surface energy ($\frac{1}{2}m \times V^2$: annular front section of the energized launcher (10) which permits a considerable shock wave to be generated accompanied by laceration and wounding.

b-a second neutralizing effect is achieved by the progressive fragmenting of the energized launcher (10).

c-the release of the flechette (2).

During the attack phase of the target by the energized launcher (10), the latter tends to slide towards the rear of the flechette body (13) of the flechette (2), thereby releasing the flechette (2) with all the power of the full bullet (1).

In a second phase, the flechette (2), the release of which has absorbed practically no energy, then strikes the target with all its energy. The target having become less hard as a result of the work carried out by the energized launcher (10) during the first phase, it is readily possible for the flechette (2) to enter into the target with all its energy.

The power of the flechette makes it possible for the hard parts of the target to be smashed, essentially as a result of the very high kinetic surface energy of the flechette (2) ($\frac{1}{2}m \times V^2$/maximum front section of the flechette body) and to the neutralizing power of the conical head (4) of the flechette (2). The flechette (2) having been very stable during the attack, the kinetic surface energy delivered by said flechette in the target remains homogeneous and very high. The excellent stability of the flechette (2) during the attack makes it possible to prevent spoiling of the venison of the game, in the case of a hunting bullet. It also limits the tendency to ricochet, for example from tree trunks.

As a result of this attack mechanism in two phases, it is possible to obtain very high kinetic surface energies in respect of the energized launcher (10) and the flechette (2), thus generating shock waves, while ensuring fragmentation of the energized launcher (10), which is indispensable when the full bullet strikes a soft part of the target.

Figure 3:
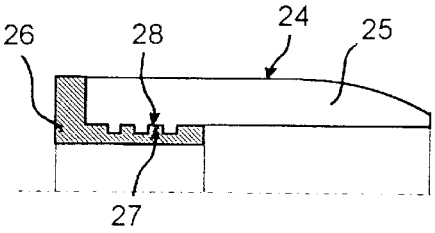
FIG. 3 is a diagrammatic section of a variation of the front part of the launcher of FIG. 1.

FIG. 3 shows an embodiment of an energized launcher (24) according to the invention, which comprises a front part (25) of lead or of an alloy, and a rear part (26) in the form of a ring which is provided with a shoulder and comprises complemental configurations (27) which co-operate with the grooves (28) which are provided in the front part (25).

This embodiment proves particularly useful when firing bullets at a very high rate of acceleration during the launching phase, making it possible to ensure an excellent mechanical behaviour.

Figure 4:
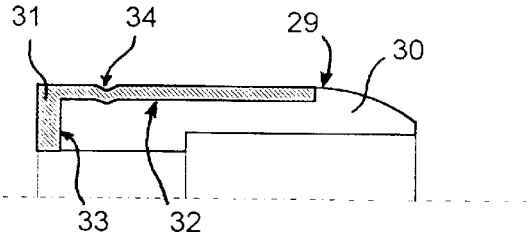
FIG. 4 is a diagrammatic section of a further variation of the front part of the launcher.

A different embodiment of the energized launcher is shown in FIG. 4, in which the launcher (29) itself is also formed by two parts: a front part (30) of an alloy, and a rear part (31) which protects the outer part (32) and the rear (33) of the front part (30). This rear part (31) is provided with a groove (34) to permit crimping of the flange of the case.

This embodiment makes it possible for the barrel of the weapon not to be fouled up or leaded during the launching phase and to facilitate the control of the final effect desired with regard to the target.

According to a variation (not illustrated), the rear part may cover the greater part of the ogive of the front part.

Figure 5:
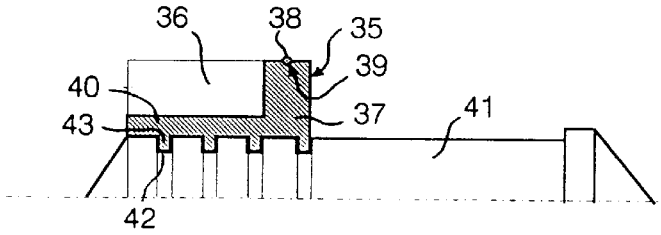
FIG. 5 is a diagrammatic section of a sub-projectile comprising a stabilizer of fins.
Figure 6:
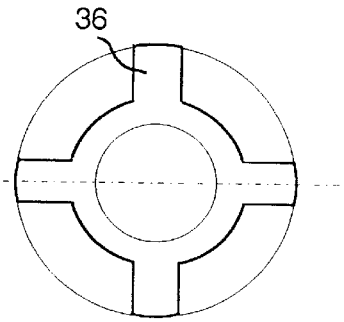
FIG. 6 is a front view of the fin assembly of FIG. 5.

FIG. 5 shows a stabilizer (35) formed by four fins (36), a thrust plate (37), supporting a toric joint (38) which is embedded in a circular groove (39), and a stabilizer body (40) of a plastics material. The stabilizer (35) is integral with the flechette body (41) via circular grooves (42) which co-operate with complemental configurations (43). The four fins (36) are shown more clearly in FIG. 6.

This embodiment is particularly useful to increase the lift of the full bullet on its trajectory and to extend the extent of guiding of the bullet during the propulsion phase.

According to a simple variation, the stabilizer (35) may be restricted to the thrust plate (37) which is complemented along its periphery by the toric joint (38). This variation makes it possible to reduce the volume occupied by the stabilizer in the propellant powder when the full bullet is in place in the case of the cartridge.

Figure 7:
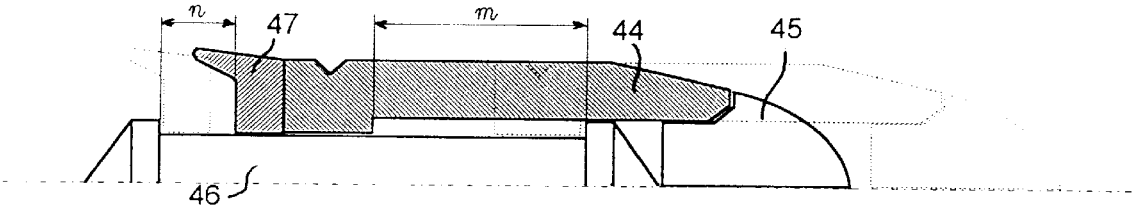
FIG. 7 is a diagrammatic longitudinal section of a different embodiment of the sliding stabilizer.

FIG. 7 shows a full bullet according to the invention, in the retracted position. This full bullet is formed by an energized launcher (44) provided with a ballistic cap (45), an flechette (46) and a stabilizer (47) free in translatory motion on the flechette (46).

The ballistic cap (45) permits a reduction in the aerodynamic drag of the bullet when in flight and an improved control of the explosion of the energized launcher (44) at the time of impact on the target. The flechette (46) comprises a conical head at its two extremities at the front and at the rear.

The launcher (44), together with its cap (45), and the stabilizer (47) are shown in solid lines in the retracted position, and in dotted lines in the deployed position. In the retracted position, the stabilizer (47) is separated from the rear conical head by the distance (n), while it is possible for the launcher (44) to slide on the body of the flechette (46) across a distance (m). At the start of the trajectory, and through a difference in the aerodynamic drag, the full bullet is deployed along a length which is equal to m+n, the stabilizer (47) coming to rest against the rear conical head, and the energized launcher (44) coming to abut against the front conical head of the flechette (46).

Numerous variations of the ammunition according to the invention, more specifically adapted to particular applications, are described in the following Examples.

Example 1

Figure 8:
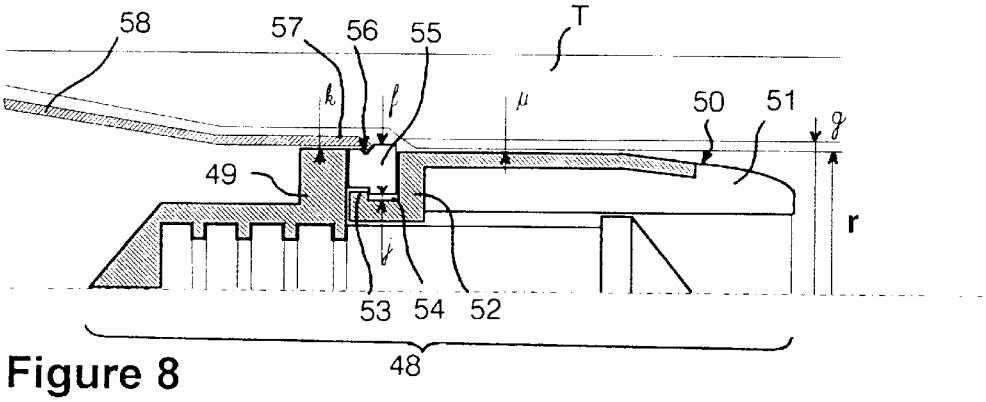
FIG. 8 is a diagrammatic section of a different embodiment of the ammunition according to the invention, adapted to a rifled tube weapon.

The full bullet shown in FIG. 8 is used for the firing of bullets from heavily rifled tubes, while the full bullet shown in the preceding Figures is used essentially for firing from smooth-bore guns or from lightly rifled guns.

The full bullet (48) shown in FIG. 8 is stabilized by the stabilizer (49).

The energized launcher (50) is formed by its front part (51), of an alloy, and its rear part (52) of a hard metal alloy, such as brass. The rear part (52) comprises a shoulder (53) and a groove (54) in which a ring (55) of plastics material co-operates with an annular clearance j of between 0.1 mm and a few tenths of a millimetre. The ring (55) is mounted for free rotation, but is locked in translation, and it comprises a crimping groove (56) which is matched, in its rear part, by the flange (57) and the case (58). Said ring has an outside diameter f upstream of the groove (56) greater by about 0.1 mm to 0.3 mm than the bottom diameter g of the rifle grooves of the tube (T) of the weapon. The outside diameters k of the stabilizer (49) and $\mu$ of the energized launcher (50) are slightly less than the inside diameter r of the tube of the weapon, the difference being less than 0.1 mm.

The working principle of this device is as follows.

Once pressure has built up, the uncrimping takes place. The ring (55) thus assumes the rifling of the barrel of the weapon and then rotates at the rate of rotation permitted by this rifling. At the same time, it ensures a good tightness of the full bullet (48) with regard to the propellant gas. In its movement, said ring carries the full bullet (48) along in a light rotation, simply by friction. On leaving the barrel, the ring (55) breaks under the effect of the centrifugal force and, simultaneously, the full bullet (48) commences its movement of deployment.

This device thus permits a breaking free from the rate of rotation imposed by the heavily rifled tube, while contributing the advantages described above.

Example 2

In this Example, the energized launcher comprises a front central nozzle which is in communication with the annular nozzles which channel the flow of air, according to an embodiment described in French patent application 94.10922.

Figure 9:
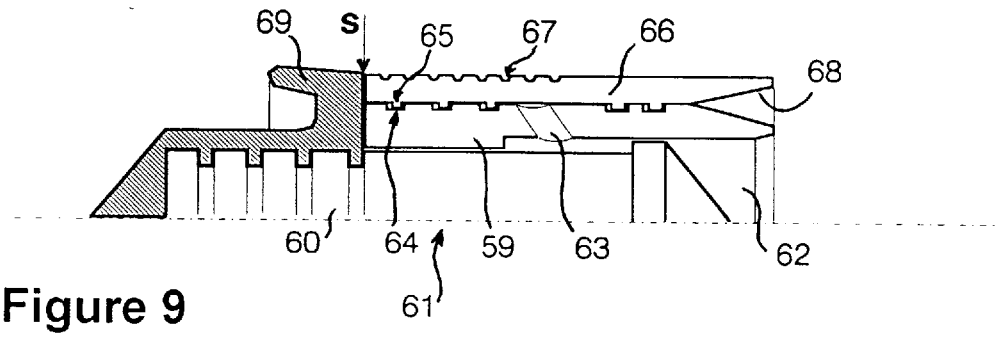
FIG. 9 is a diagrammatic section of an full bullet according to the invention, comprising a launcher composed of two concentric parts, adapted to a large calibre weapon.

The full bullet shown in FIG. 9 is adapted to be fired from a weapon of a relatively large calibre and comprises an energized launcher comprising two components: an inner component and an outer component.

The inner energized launcher (59) is similar to that of the preceding Example, and is capable of sliding along the body (60) of the flechette (61). It comprises a central nozzle (62) which is open toward the front and communicates with four annular nozzles (63) which pass through the wall of the inner energized launcher. The cylindrical outer part comprises a series of circular grooves (64) which co-operate with the complemental configurations (65) of the outer launcher (66).

This outer launcher (66) comprises two components which are placed face to face and co-operate with the circular grooves (64) of the inner energized launcher (59). The outer launcher (66), of a technical plastics material, comprises circular decompression grooves (67) on its periphery, and an inner cone (68) on its front part.

The diameter (s) of the front of the stabilizer (69) of the flechette (61) is the same as that of the weapon calibre. The complete projectile (70) is formed by the flechette (61) with its stabilizer (69), the inner energized launcher (59) and the outer launcher (66).

During the launching phase, the complete projectile (70) is in the position shown in FIG. 9, then, having left the tube of the weapon, the components of the outer launcher (66) become detached from the inner launcher (59) under the effect of aerodynamic forces acting on the cone (68) and through the annular nozzles (63) which communicate with the central nozzle (62). At the same time, the inner energized launcher (59) slides towards the front, on the body (60) of the flechette (61), and comes to abut against the conical head of the arrow.

The components of the outer launcher (66) which have become detached, fall down at an average distance of 30 m with a maximum deviation of 7 m relative to the firing plane.

According to a variation of the embodiment which is adapted, in particular, to weapons having a tube of a small diameter, the inner energized launcher (59) is at the calibre of the weapon, and the outer launcher (66) is then omitted. The other components remain unchanged.

Example 3

Figure 10:
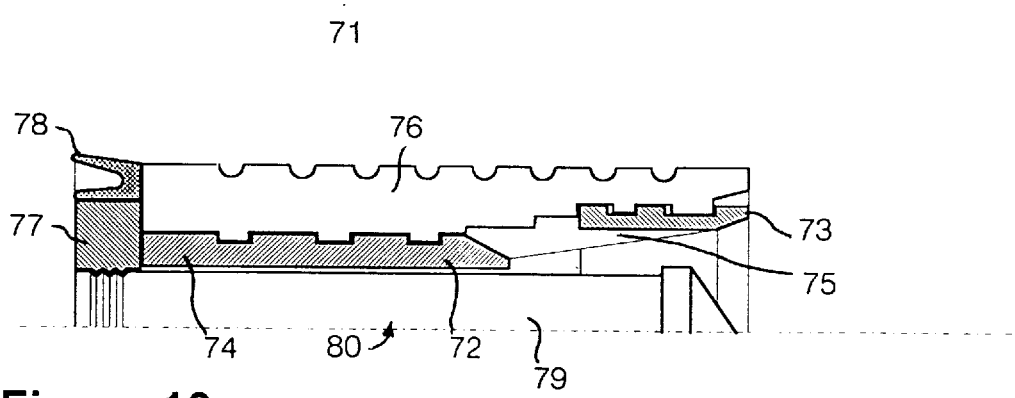
FIGS. 10 and 11 show a variation of the bullet of FIG. 9.

FIG. 10 shows another bullet according to the present invention, in the retracted position, in the manner in which it is located in a cartridge and during the launching phase.

In the bullet shown in this FIG. 10, the full bullet (71) comprises an arrow, a stabilizer and an energized launcher comprising an inner component and an outer component, as in the preceding Example. The inner energized launcher (72) comprises a front component (73) and a rear component (74). The diameter of the front component (73) of the launcher is greater than the diameter of the rear component (74) , but smaller than the calibre of the weapon. The two components (73) and (74) are connected by vanes (75) which define annular nozzles according to technique described in French patent application 94.10922.

The outer launcher (76), which is substantially at the calibre of the weapon, is of a technical plastics material and is formed by two components which are symmetrical relative to the axis of the bullet, placed face to face, as in the preceding Example. The outer component (76) and the inner energized component (72) co-operate by means of complemental configurations and grooves, as in the preceding Examples. Decompression grooves are provided on the outer surface of the outer launcher (76).

The stabilizer (77) is also produced from a plastics material, and its outside diameter is distinctly smaller than the calibre of the weapon. It is completed by an annular seal (78) comprising two flexible lips which permit ensuring the complete tightness of the full bullet (71) to the propellant gases during the launching phase.

Having left the tube of the weapon, the two components of the outer launcher (76) become detached from the inner energized launcher (72), and the latter slides on the flechette body (79) to come to abut against the conical head of the flechette (80). At the same time, the seal (78) is detached from the stabilizer (77).

Example 4

This Example describes an embodiment which is similar to that of Example 3, but in which the front component of the launcher and the stabilizer are at the calibre of the weapon.

Figure 11:
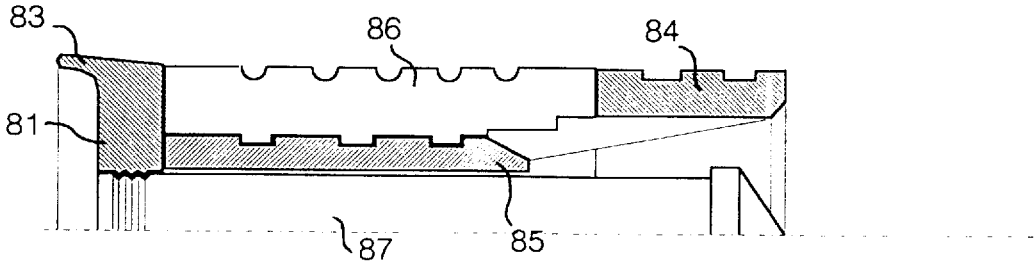

Due to its flexible lip (83), the stabilizer (81), at the calibre of the weapon, ensures the tightness of the full bullet (82) during the launching phase. The outside diameter of the front component (84) of the energized launcher (85) is very slightly smaller than the calibre of the weapon. The outer launcher (86), of a technical plastics material, comprises two components which are placed face to face and are symmetric relative to the longitudinal axis of the bullet. When the bullet is in the retracted position, as shown in FIG. 11, the outer launcher (86) is locked between the stabilizer (81) and the rear edge of the front component (84) of the energized launcher (85).

Following the same procedure as described above, having left the tube of the weapon, the components forming the outer launcher (86) become detached from the energized launcher (85), and the latter slides on the flechette body (87).

In such an exemplified embodiment, the mass of the energized launcher may be about 20 g, while the mass of the flechette is 5 g and that of the outer launcher of plastics material is about 2 g. The total length of the full bullet is about 42 mm in the retracted position and 60 mm in the deployed position.

An embodiment of this kind permits obtaining, under normal conditions of use, a kinetic energy in respect of the bullet, measured when leaving the tube of the weapon, of about 3445 joule, and a kinetic surface energy upon impact on the target of about 35 j/mm$^2$.

According to a variation of the embodiment, the outer launcher (86) may be provided to be integral with the stabilizer (81), thus forming a launcher-thruster of a plastics alloy which is connected to the flechette and remains integral therewith during the entire trajectory.

I claim:

1. Ammunition for weapons of varying calibre, comprising:

a sub-projectile including a conical head and a stabilizer;

a launcher connected to the sub-projectile and having the same calibre as the weapon, the sub-projectile, the stabilizer and the launcher being enclosed in a cartridge which comprises a primer socket and a Propellant charge, wherein at least a portion of the launcher is non-detachably connected to and slides along the sub-projectile in a direction parallel to a longitudinal axis of the sub-projectile, and said portion of the launcher extends beyond the conical head of the sub-projectile in a direction of and at least during a trajectory of the ammunition.

2. Ammunition according to claim 1, wherein a mass ratio of the launcher to the sub-projectile is between 2:1 and 8:1.

3. Ammunition according to claim 1, wherein the launcher includes a revolving part comprising two concentric bores.

4. Ammunition according to claim 3, wherein a diameter of a front bore of the launcher is greater than a diameter of a rear bore of the launcher.

5. Ammunition according to claim 1, wherein the launcher slides across a distance of between ¼ and ¾ of a length of the sub-projectile.

6. Ammunition according to claim 1, wherein the launcher comprises an outer casing of a high-strength material.

7. Ammunition according to claim 1, wherein the launcher comprises a front part and a rear part, the rear part forming a ring which is provided with a shoulder.

8. Ammunition according to claim 1, wherein the launcher comprises two concentric tubular parts.

9. Ammunition according to claim 8, wherein an outer part of the two concentric tubular parts comprises at least two detachable parts which are symmetric with respect to a longitudinal axis of the launcher.

10. Ammunition according to claim 8, further comprising nozzles which channel air from an interior of the launcher to an exterior of the launcher, and pass through a wall of an inner part of the launcher.

11. Ammunition according to claim 1, wherein the sub-projectile comprises a thrust plate which is integral with the stabilizer.

12. Ammunition according to claim 11, wherein the thrust plate comprises a seal having a flexible lip placed on a periphery of the thrust plate.

13. Ammunition according to claim 11, wherein the trust plate comprises one of an annular seal and a toric seal on its outer surface.

14. Ammunition according to claim 1, wherein the stabilizer is attached to and slides along the sub-projectile in a direction parallel to the longitudinal axis of the sub-projectile.

* * * * *